United States Patent [19]

Ridder

[11] 4,207,028

[45] Jun. 10, 1980

[54] EXTENDABLE AND RETRACTABLE PROPELLER FOR WATERCRAFT

[76] Inventor: Sven O. Ridder, Tykovagen 4B, 181 61 Lidingo, Sweden

[21] Appl. No.: 47,795

[22] Filed: Jun. 12, 1979

[51] Int. Cl.[2] ..... B63H 1/24

[52] U.S. Cl. ..... 416/142; 416/148; 416/175

[58] Field of Search ..... 416/142 R, 142 A, 148, 416/131, 143, 175, 203

[56] References Cited

U.S. PATENT DOCUMENTS

| | | | |
|---|---|---|---|
| 1,491,997 | 4/1924 | Messick | 416/131 |
| 1,899,650 | 2/1933 | Stelzer | 416/131 |
| 2,222,444 | 11/1940 | Schmidt et al. | 416/203 |
| 2,231,464 | 2/1941 | Dubbs | 416/131 |
| 2,481,751 | 9/1949 | James | 416/142 |
| 3,575,530 | 4/1971 | Hall | 416/175 X |
| 3,981,613 | 9/1976 | Ehrenskjold et al. | 416/142 |

FOREIGN PATENT DOCUMENTS

| | | | |
|---|---|---|---|
| 53706 | 1/1912 | Austria | 416/131 |
| 306047 | 8/1971 | U.S.S.R. | 416/203 |

*Primary Examiner*—Everette A. Powell, Jr.
*Attorney, Agent, or Firm*—William E. Mouzavires

[57] ABSTRACT

For a watercraft which may be a powered craft or a sailboat with an auxiliary engine, a propeller which will pivot relative to its propeller shaft about an axis extending transversely of the propeller shaft so that the propeller retracts into general longitudinal alignment with the propeller shaft. The propeller includes two blades fixed to each other as a unit with a pivot pin passage formed at the juncture of the two blades. In one preferred form, one of the propeller blades is made larger than the other with the smaller blade positioned rearwardly in relation to the pivot pin passage and the larger blade forwardly of the passage. Furthermore, in this embodiment, the pivot pin passage extends at a relatively slight teetering angle to a plane extending perpendicular to the propeller shaft axis.

12 Claims, 5 Drawing Figures

FIG 1
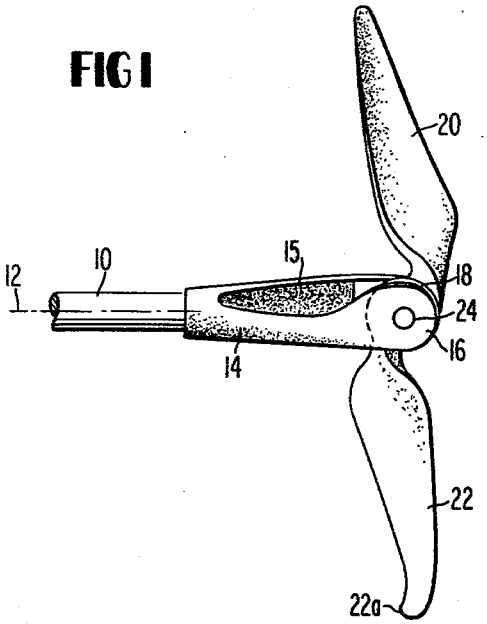
FIG 2
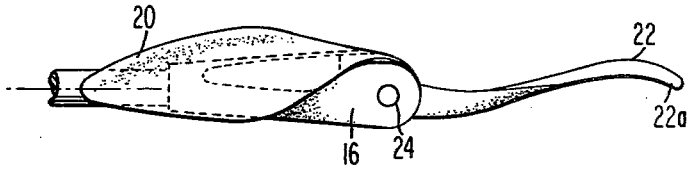
FIG 3
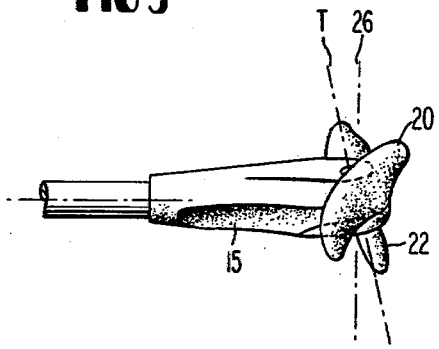
FIG 4
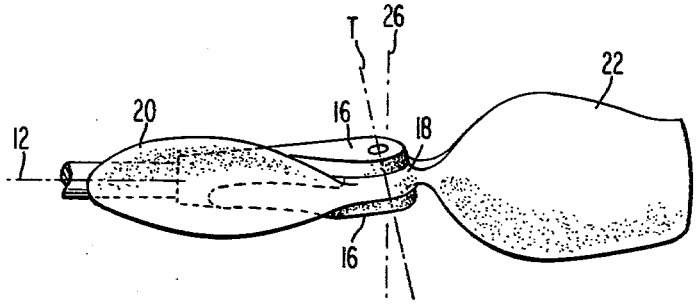
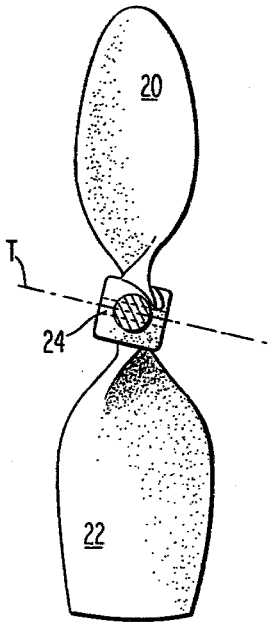
FIG 5

EXTENDABLE AND RETRACTABLE PROPELLER FOR WATERCRAFT

BACKGROUND OF INVENTION

In large powered watercraft or vessels, the propeller shaft is often made of an exceedingly large size and strength in order to withstand the vibrations imparted to it from the propeller blades during operation. In addition, the propeller shaft is subjected to unbalanced moments stemming from the forces which are imposed by the sea on the portions of the propeller blades which are exposed or above the waterline during operation. These unbalanced forces can result in bending of the propeller shaft, and moreover, can produce resonant vibrations which can seriously damage not only the propeller shaft, but also its bearings.

With reference to sailing boats or yachts which utilize inboard auxiliary engines, a fixed propeller forms an unwarranted extra drag that impairs the sailing performance of the boat. In order to limit this degradation of performance, a number of various designs of special sailboat propellers have been advanced and some of these have been produced in quantity during the past years. Of these attempted technical solutions, two main groups are discernable.

One group consists of a so-called "feathering" propeller where the blade pitch angle can be changed, that is, an angular rotation of the blade along its radial axis out from the propeller shaft in a longitudinal direction of each propeller blade. In order to decrease the drag of the propeller when sailing, the blades are rotated (feathered) manually or automatically so that the blade surface is aligned with the oncoming stream to reduce the frictional drag when compared to that produced by typical "non-feathered" propeller blades.

The other group is constituted by so-called folding propellers where each of the blades of the propeller are folded rearward in the direction of flow when sailing. When the engine is started and the propeller shaft begins to turn, the centrifugal force makes the blades flap outward so that the propeller can work with the blades in a mainly radial position. The present invention in broad context only, may be considered as being related to this latter group.

The operational disadvantages with the earliest types of folding propellers have among other things been associated with the following problems: At low speeds the unfolding of the blades to operative position is not achieved due to the weight of the blades and the friction in the folding mechanism. Further, when the engine is started, it sometimes occurs that only one blade is extended causing a severe unbalance that often destroys the propeller shaft support bracket. Finally, the ability to provide thrust in reverse, especially the ability to brake at forward speed, is usually very poor in comparison with a fixed propeller. This deficiency is caused by the tendency of the blades to fold rearwards when the propeller thrust is reversed.

In attempting to solve or alleviate some of the above problems, the following arrangements have been used or proposed:

(a) Folding propellers with very thick blades in order to generate a high centrifugal force upon rotation to strive to counteract the tendency to fold during reverse speed.

(b) Providing the tips of the blades with cast-in magnetos in order to retain a folded blade position also at low speeds.

(c) Synchronizing the folding action of the two blades by means of intermeshing gear segments at the blade roots. This is to prevent asymmetric extension of the blades when the engine is started and also to prevent extension of one blade due to the weight of the blade when sailing at low speeds.

(d) Augmenting extension of the blades due to centrifugal force through a special mechanism that is actuated by the torsional moment of the propeller shaft.

None of the above attempts are believed to have adequately solved the problem, not only from the standpoint of operation but also, from the standpoint of providing an uncomplicated propeller structure that will withstand the forces of the sea while being durable and subject to manufacture at relatively low or practical cost.

OBJECTS OF THE PRESENT INVENTION

It is an object of the present invention to provide a new and improved propeller for a watercraft as well as a new propeller and propeller shaft assembly for a watercraft, which will reduce drag as well as vibration imparted to the propeller shaft. Included herein is the provision of such an improved propeller and propeller shaft assembly which may be manufactured relatively economically and incorporated into new or existing or conventional watercraft, including power craft or sailing yachts where it will operate dependably and with durability.

SUMMARY OF INVENTION

In its broadest form, the present invention constitutes a propeller, including at least two blades rigidly fixed to each other and hinged at their junction on a teetering axis extending transversely to an associated propeller shaft so that the propeller will pivot about the teetering axis from an extended operative position extending radially outwardly from the shaft to a retracted position extending longitudinally of the propeller shaft. In this folded or retracted mode, one propeller blade extends forwardly of the teetering axis along the propeller shaft and the other blade extends rearwardly from the teetering axis rearwardly of the propeller shaft.

In one preferred embodiment when used with an auxiliary engine of a sailing craft, for example, one blade is made larger than the other blade of the propeller, and when folded in retracted position, the small blade is positioned forwardly along the propeller shaft and the larger blade extends rearwardly beyond the propeller shaft longitudinally thereof. Furthermore, the tip of the larger blade is curved in a direction generally laterally thereof so that when folded, the water flow will tend to cause the blade to remain in the folded position. In addition, the teetering axis, although extending generally transversely of the longitudinal axis of the propeller shaft, is made to extend at a slight angle relative to a plane which is perpendicular to the propeller shaft.

In operation, the propeller will be extended by centrifugal force during rotation of the propeller shaft. However, when the engine is off, the forces of the water will cause the propeller to fold so as to extend generally in the same longitudinal direction of the propeller shaft and in close proximity thereto so as to significantly reduce the drag that would otherwise be caused by the propeller blades.

Other novel features and advantages of the present invention will be described and become apparent from the following more detailed description taken in conjunction with the attached drawings in which:

FIG. 1 is a side elevational view of a propeller and propeller shaft assembly embodying the present invention and shown with the propeller in the extended or operative mode;

FIG. 2 is a view taken similar to FIG. 1 but with the propeller shown in idle mode in retracted position;

FIG. 3 is a plan view of the parts when the propeller is in the extended or operative mode;

FIG. 4 is a plan view of the parts when the propeller is in the idle or retracted mode; and FIG. 5 is a rear end view of the propeller when in the extended operative mode.

DETAILED DESCRIPTION

Referring now to the drawings in detail, there is shown for illustrative purposes only, a propeller assembly embodying the present invention for use in a watercraft such as a sailboat or sailing yacht. The assembly includes a propeller shaft 10 adapted to be rotated by an associated engine (not shown) about a propeller shaft axis 12 for propelling a watercraft, not shown. A propeller mounting sleeve 14 is received over and fixed to the end of the propeller shaft 10. In the specification shown, sleeve 14 includes at its rear end, a bifurcated or forked portion 16, in which is pivotally mounted or hinged a hub 18 of a propeller which includes two propeller blades 20 and 22 rigidly fixed relative to each other through the hub 18. In the shown embodiment, the propeller including the blades 20 and 22 and their hub 18 are formed from a one-piece integral structure. Propeller hub 18 is received between bifurcated portions 16 of sleeve 14 and pivotally mounted therein by means of a suitable hinge pin 24 received through a central passage in propeller hub 18 and through passages formed in alignment through bifurcated portions 16 of sleeve 14.

In one preferred embodiment, the passages formed in the bifurcated portions 16 of sleeve 14 are such that pivot pin 24 extends along what will be termed a "teetering axis T" which extends at an angle to a plane or axis generally desingated 26 which is perpendicular to axis 12 of the propeller shaft. It should be noted that the teetering axis T not only extends at an angle to the plane 26 which is perpendicular to the propeller shaft axis 12 but also, it extends at the same angle relative to a horizontal plane when the propeller is in a vertical position such as shown in FIG. 5.

Furthermore, in one preferred embodiment particularly suitable for use with engines used on sailboats, one propeller blade is larger than the other propeller blade. In the specific embodiment shown, propeller blade 22 is larger in radial and transverse dimension than propeller blade 20. In this manner the drag on the propeller, when in the extended position shown in FIG. 1, is higher on one blade than the other and this promotes folding of the propeller into retracted position shown in FIG. 2 when the engine is deenergized or idling. However, in order to get approximately balanced thrust from the two blades 20 and 22 for propelling the associated boat, the smaller blade 20 is made with a slightly higher pitch or angle as shown in FIG. 3, where it will be seen that the general plane of the blade extends at a greater angle relative to the plane 26 than that of the larger blade 22. Moreover, the larger blade 22 is made sightly thinner than the smaller blade 20 in order to make the center of gravity of the entire propeller unit coincide with the intersection of the teetering axis T and axis 12 of the propeller shaft. The teetering axis T is chosen with a view towards making it coincide with a plane passing as close as possible to the major plane of the larger propeller blade 22 and also with a view towards allowing the propeller, in its folded postion, to come as close as possible to parallel with the propeller shaft axis 12.

In addition, in the preferred embodiment, the smaller blade 20 is displaced a certain distance rearwards and with the larger blade 22 the same distance forwards, in relation to the hinge pin 24 as shown in FIG. 1. This displacement makes it possible for the smaller blade 20 to pivot forwards through 90° to a position almost parallel with the propeller shaft 10 while, at the same time, maintaining the axis 12 of the propeller shaft coincident or intersecting the center of gravity of the propeller while in the folded or retracted position. In order to obtain complete folding of the propeller into the desired position, it is further preferred that a length of sleeve 14 be provided with an elongated surface recess 15 for receiving portions of the smaller propeller 20 when in folded position.

It is also preferred that the tip **22*a* of the larger blade 22** be projected such as on an arc laterally of the blade so as to provide a force component from the water flow tending to urge the blade in retracted position.

In operation, when the propeller shaft 10 is powered and rotated, the propeller 20, 22 is moved to extended position shown in FIGS. 1, 3 and 5 due to centrifugal forces. However, when propeller shaft 10 is idled or not being powered, such as when sailing, the propeller 20, 22 will pivot about teetering axis T with the small blade 20 moving forwardly along the propeller shaft 10 and with the larger blade 22 moving rearwardly extending in the longitudinal direction of and beyond the propeller shaft 10 as shown in FIGS. 2 and 4. The drag of the propeller in this position has been estimated to be less than ten (10%) percent of the drag when the propeller is in the extended position. The orientation of the teetering axis T is intended to facilitate the folding action of the propeller. According to actual tests, the hydrodynamic interference between the two blades 20 and 22 will tend to stabilize the propeller (when sailing) in position halfway between the extended and folded position of the propeller. The effect of this angular displacement can be looked upon in the following manner. The component of the drag of the larger blade 22 normal to the teetering axis T, is increased while the drag component of the smaller blade 20 is conversely decreased which promotes the desired folding action.

From the above, it can be seen that the present invention achieves mechanical simplicity by utilizing only one movable part which provides low manufacturing costs and reliable operation. Moreover, the functioning is reliable because the teetering axis T and the axis of the propeller shaft intersect at the center of gravity of the propeller thus reducing or eliminating the risk for imbalance while minimizing friction during folding. Moreover, in the reverse mode, that is when reversing the associated watercraft, the present invention provides an increased thrust, and the respective thrust components on the two propeller blades approximately balance each other so that the tendency of the propeller to fold in the reverse mode is diminished.

What is claimed is:

1. A propeller assembly for a watercraft comprising a propeller shaft, a propeller including a hub and first and second diametrically opposed blades fixed relative to each other for movement as a unit, and means mounting the propeller to the propeller shaft for pivotal movement about an axis extending generally transversely to the propeller shaft between an extended position with the blades projecting generally radially from said shaft and a folded position with one propeller blade extending forwardly generally along the propeller shaft and the other propeller blade extending rearwardly of the propeller shaft generally longitudinally thereof.

2. The assembly defined in claim 1 wherein said axis extends at a certain angle relative to a plane intersecting the propeller shaft at right angles.

3. The assembly defined in claim 1 wherein portions of said one propeller blade adjacent the hub are displaced rearwardly of said axis and wherein portions of said other blade adjacent the hub are displaced forwardly of said axis.

4. The assembly defined in claim 1 further including a sleeve fixed to the propeller shaft and wherein said propeller is mounted to said sleeve and wherein said sleeve has a longitudinal recess in one surface thereof for receiving portions of said one propeller blade when the propeller is in the folded position.

5. The assembly defined in claim 1 wherein said other propeller blade has its extremity projecting at an angle generally laterally thereof for providing a component of force from the water tending to maintain the propeller in folded position.

6. The assembly defined in claim 1 wherein said one propeller blade is smaller in radial length than said other propeller blade.

7. The assembly defined in claim 1 wherein said one propeller blade is narrower in chord than said other propeller blade.

8. The assembly defined in claim 6 wherein said one propeller blade has an angle of pitch greater than the angle of pitch of said other propeller blade.

9. The assembly defined in claim 7 wherein said other propeller blade is slightly thinner in cross section than said one propeller blade.

10. The assembly defined in claim 1 wherein said axis and the axis of the propeller shaft intersect generally at the center of gravity of the propeller.

11. A propeller for an engine of a watercraft such as a power boat or a sailboat, the propeller comprising a hub and two blades fixed to and projecting radially from the hub in generally diametrically opposed position, said hub having means for mounting the propeller to a propeller shaft for pivotal movement about an axis lying in a diametrical plane passing through the hub and portions of the blades for positioning the blades in an extended position projecting generally radially from the associated shaft or a retracted folded position extending longitudinally of the associated shaft.

12. The propeller defined in claim 11 wherein one blade has a larger radial length than the other blade.

* * * * *